United States Patent [19]

Gardner et al.

[11] Patent Number: 4,632,429

[45] Date of Patent: Dec. 30, 1986

[54] METHOD OF RENDERING DOCUMENTS RESISTANT TO PHOTOCOPYING AND ANTI-COPYING PAPER THEREFOR

[75] Inventors: Norman A. Gardner; Michael P. Voticky, both of Montreal, Canada

[73] Assignee: Nocoi Inc., New York, N.Y.

[21] Appl. No.: 475,791

[22] Filed: Mar. 16, 1983

Related U.S. Application Data

[63] Continuation-in-part of Ser. No. 443,819, Nov. 23, 1982, Pat. No. 4,522,429, which is a continuation-in-part of Ser. No. 379,674, May 19, 1982, abandoned.

[51] Int. Cl.[4] ..... B41M 3/14

[52] U.S. Cl. ..... 283/91; 283/902; 427/7; 427/258; 428/195; 428/211; 428/916; 430/10; 430/56; 430/127; 430/950

[58] Field of Search ..... 430/10, 56, 127, 938, 430/950; 428/195, 207, 211, 916; 427/7, 258; 283/91, 92, 902

[56] References Cited

U.S. PATENT DOCUMENTS

| | | | |
|---|---|---|---|
| 3,597,082 | 8/1971 | James et al. | 430/10 |
| 3,852,088 | 12/1974 | Godlewski et al. | 283/902 |
| 3,887,742 | 6/1975 | Reinnagel | 428/211 |
| 4,118,122 | 10/1978 | Rees et al. | 283/91 |
| 4,175,776 | 11/1979 | Ranauro | 283/91 |
| 4,277,514 | 7/1981 | Sugiura et al. | 283/91 |
| 4,307,899 | 12/1981 | Hoppe | 283/91 |
| 4,522,429 | 6/1985 | Gardner et al. | 428/195 |

*Primary Examiner*—George F. Lesmes
*Assistant Examiner*—William M. Atkinson
*Attorney, Agent, or Firm*—Robert F. Delbridge; Arne I. Fors

[57] ABSTRACT

A document has information appearing thereon, with at least a portion of the information being located on a front face of a portion of the document. The front face portion has a color with a sufficiently low reflection spectral response to render the document portion substantially incapable of being photocopied in an information-readable manner. The document portion is capable of transmitting visible light from the rear face to the front face to cause sufficient contrast between the relatively non-translucent information and the transmitted light to enable the information to be read by a human eye viewing the front face of the document when visible light is transmitted through the document from the rear face to the front face.

18 Claims, 2 Drawing Figures

Figure 1:
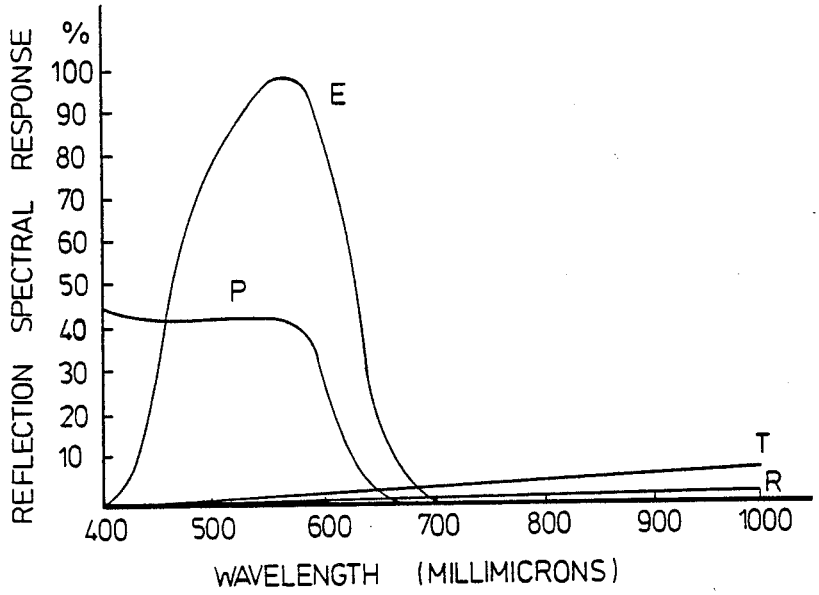

METHOD OF RENDERING DOCUMENTS RESISTANT TO PHOTOCOPYING AND ANTI-COPYING PAPER THEREFOR

RELATED PATENTS AND/OR APPLICATIONS

This is a continuation-in-part of Ser. No. 443,819, filed Nov. 23, 1982, now U.S. Pat. No. 4,522,429 issued June 11, 1985, which is a continuation-in-part of Ser. No. 379,674, filed May 19, 1982, now abandoned.

This invention relates to rendering documents resistant to photocopying, and inter alia provides an extremely novel and useful anti-photocopying paper.

The present day ready availability of photocopiers has given rise to the problem of rendering documents or portions thereof resistant to photocopying. It is now unduly easy for a person to make an unauthorized photocopy of a document carrying confidential information, unless the document is resistant to photocopying. Various attempts have been made to render documents resistant to photocopying by covering information on a document with a transparent film which permits the information to be seen by the human eye but which prevents an adequate photocopy being made. U.S. Pat. Nos. 3,887,742 and 4,118,122 disclose proposals of this kind but for one reason or another, neither of these proposals provides a satisfactory solution to the problem of rendering documents resistant to photocopying.

Our previously mentioned U.S. Pat. No. 4,522,429 discloses and claims (inter alia) an antiphotocopying paper which has substantial advantages over the prior art. The anti-photocopying paper which is the subject of that U.S. patent has a colour with a reflection spectral response of less than about 10% for light with a wavelength below about 600 millimicrons and yet which is sufficiently visually contrasting with information, when the information is typed thereon or otherwise applied thereto, to enable the information to be read by the human eye when the paper is viewed under white light.

We have now discovered an even more improved manner of rendering documents resistant to photocopying.

In accordance with this further invention, a document has information appearing thereon with at least a portion of the information being located on a front face of the portion of the document, and the front face portion has a colour with a sufficiently low reflection spectral response to render the document portion substantially incapable of being photocopied in an information-readable manner, that is to say with the information having a similar low reflection spectral response, and said document portion being capable of transmitting visible light from the rear face to the front face to cause sufficient contrast between the relatively non-translucent information and the transmitted light to enable the information to be read by a human eye viewing the front face of the document when visible light is transmitted through the document from the rear face to the front face thereof.

The reflection spectral response is advantageously substantially zero for light with a wavelength below about 625 millimicrons, preferably substantialy zero for light with a wavelength below about 650 millimicrons, and more preferably substantially zero for light with a wavelength below about 700 millimicrons.

The portion of the document carrying information which is not to be photocopied preferably has a transmission factor averaging 3% in the visible light range. Advantageously, the transmission factor ranges from substantially zero for light with a wavelength of about 450 millimicrons to about 5% for light with a wavelength of about 700 millimicrons. Usually, the information will be in a substantially black relatively non-translucent colour.

Thus, in accordance with the present invention, the document is particularly resistant to photocopying since photocopiers require the document to have an adequate reflection spectral response for light of wavelengths to which the photocopier responds. Most photocopiers do not respond to light with a wavelength above about 625 millimicrons, and are most unlikely to respond to light with a wavelength above about 650 millimicrons. A document in accordance with the present invention therefore is very effectively resistant to photocopying.

On the other hand, a document in accordance with the present invention can be very easily read by means of visible light transmitted through the document from the rear. The visible light may simply be daylight or other ambient light or may be a light which is specifically intended for reading a document in accordance with the present invention. The low reflection spectral response may be provided by applying a suitable ink to a suitable paper or by applying a suitable pre-manufactured colour film to a suitable paper.

Figure 2:
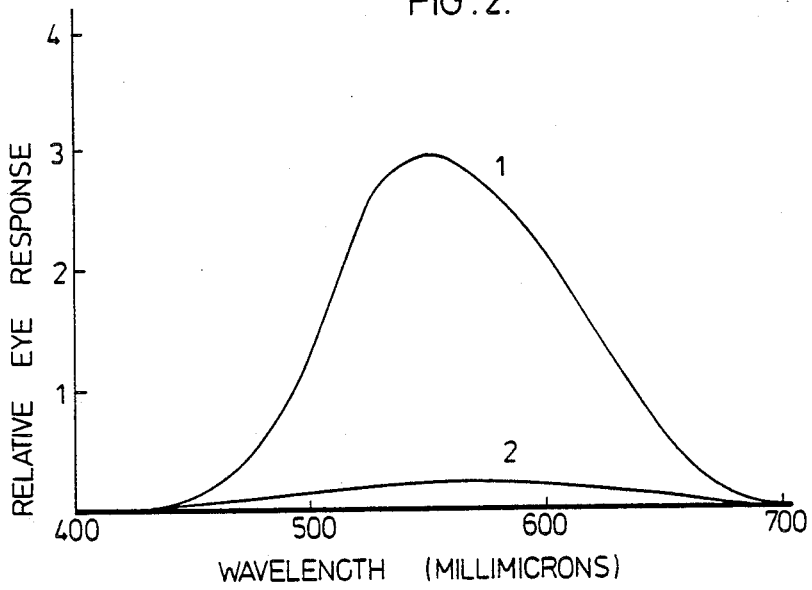

One embodiment of the present invention will now be described by way of example, with reference to the accompanying drawings, of which:

FIG. 1 is a graph showing the reflection spectral response and transmission factor of anti-photocopying paper in accordance with one embodiment of the invention, and also showing the average spectral response of the human eye and a typical spectral response of a photocopier, and FIG. 2 is a graph showing the readability of information on the paper when viewed by means of reflected incident light and by means of transmitted light.

Referring first to FIG. 1, a document comprises a sheet of coloured paper having a transmission factor indicated by the line T and a reflection spectral response indicated by the line R. FIG. 1 also shows the typical spectral response of the human eye by the line E and a possible spectral response of a photocopier by the line P.

It will be noted that the line P indicates that the spectral response of the photocopier decreases to zero at a wavelength of about 650 millimicrons, with a cut-off at about 625 millimicrons, the term "cut-off" being usually applied to the wavelength at which the spectral response has fallen to less than about 10%.

The transmission factor T of the paper increases substantially linearly from zero at a wavelength of about 450 millimicrons to about 5% at a wavelength of about 700 millimicrons, therefore averaging about 3% over the visible light range encompassed by the line E. Above the visible light range, the transmission factor increases substantially linearly to about 10% for light with a wavelength of about 1,000 millimicrons.

The reflection spectral response R is very low (substantially zero) below about 700 millimicrons, i.e. less than about 1%, and is also of this order at wavelengths above 700 millimicrons up to about 1,000 millimicrons.

The paper may for example be that sold by Kimberley Clark Corporation under the trade mark UV ULTRA II covered on the front face with matt finished "black" ink (such as produced by Cal/Ink Limited or Sinclair & Valentine Limited) to give the required transmission factor.

Information is then typed, printed or otherwise applied in black or similar dark colour on the front face of the paper so that it is relatively non-translucent. Any kind of information may of course be applied, including printed, written or drawn text, graphs or illustrations. Frequently, the information may be applied to the paper by means of a photocopier from an original document which is not resistant to photocopying. In such a case, anti-photocopying paper in accordance with the invention will be used as the copy paper in a photocopying machine, with the result that the information will appear on the paper as baked black carbon deposits.

If an attempt is made to photocopy the resultant document, the photocopy will be unreadable because the information on the photocopy will not be distinguishable from the background. In other words, the photocopy will show the background in the same colour as the information since the reflection spectral response of the paper is substantially zero below about 700 millimicrons.

On the other hand, if the document is illuminated from behind, either by positioning the document so that ambient daylight or artificial light or special artificial light passes therethrough from behind, the information can be easily read by the human eye when viewed from the front because the black or substantially black information will be sufficiently contrasting with the background which is lightened by the transmitted light.

FIG. 2 shows the relative eye response when viewing the document. Line 1 shows the eye response to viewing by light transmitted through the paper, and line 2 shows the eye response to viewing by reflected incident light. When viewing by transmitted light, the transmitted light is easily seen in contrast to the information, particularly at wavelengths to which the human eye is most responsive as indicated by line E in FIG. 1. With reflected light, the eye merely perceives the paper to be substantially black and substantially indistinguishable from the information.

The invention is of course applicable to any security documents, including lottery tickets, show and sports events tickets, postal and fiscal stamps, stock shares and bond certificates, credit cards, personal and bank cheques, travellers cheques and bank notes.

Other embodiments and examples of the invention will be readily apparent to a person skilled in the art, the scope of the invention being defined in the appended claims.

What we claim as new and desire to protect by Letters Patent of the United States is:

1. A document having substantially non-translucent information appearing thereon, with at least a portion of the information being located on a front face of a portion of the document, said front face portion having a colour with a reflection spectral response which is effectively zero for light with a wavelength below about 625 millimicrons and less than about 1% up to about 1,000 millimicrons so as to render said document portion substantially incapable of being photocopied in an information-readable manner, and said document portion being capable of transmitting visible light from the rear face to the front face to cause sufficient contrast between the substantially non-translucent information and the transmitted light to enable the information to be read by a human eye viewing the front face of the document when visible light is transmitted through the document from the rear face to the front face thereof.

2. A document according to claim 1 wherein said document portion has a transmission factor averaging about 3% in the visible light range.

3. A document according to claim 1 wherein said document portion has a transmission factor ranging from substantially zero for light with a wavelength of about 450 millimicrons to about 5% for light with a wavelength of about 700 millimicrons.

4. A document according to claim 1 wherein said information is of a substantially black substantially non-translucent colour.

5. A document according to claim 4 wherein said document portion has a transmission factor averaging about 3% in the visible light range.

6. A document according to claim 4 wherein said transmission factor ranges from substantially zero for light with a wavelength about 450 millimicrons to about 5% for light with a wavelength about 700 millimicrons.

7. A method of rendering a document with information thereon resistant to photocopying, said method comprising applying substantially non-translucent information to a front face of a document, coloring said front face with a color with a reflection spectral response which is effectively zero for light with a wavelength below about 625 millimicrons and less than about 1% up to about 1,000 millimicrons so as to render the document substantially incapable of being photocopied in an information-readable manner, and said document being capable of transmitting visible light from a rear face to the front face to cause sufficient contrast between the substantially non-translucent information and the transmitted light to enable the information to be read by a human eye viewing the front face of the document when visible light is transmitted through the document from the rear face to the front face thereof.

8. A method according to claim 7 wherein said document portion has a transmission factor averaging about 3% in the visible light range.

9. A method according to claim 7 wherein said document portion has a transmission factor ranging from substantially zero for light with a wavelength of about 450 millimicrons to about 5% for light with a wavelength of about 700 millimicrons.

10. A method according to claim 7 wherein said information is of a substantially black substantially non-translucent colour.

11. A method according to claim 10 wherein said document portion has a transmission factor averaging about 3% in the visible light range.

12. A method according to claim 10 wherein said transmission factor ranges from substantially zero for light with a wavelength about 450 millimicrons to about 5% for light with a wavelength about 700 millimicrons.

13. Anti-photocopying paper having a front face having a colour with a reflection spectral response which is effectively zero for light with a wavelength below about 625 millimicrons and less than about 1% up to about 1,000 millimicrons so as to render the document substantially incapable of being photocopied in an information readable manner, after substantially non-translucent information has been typed or otherwise applied to said front face, and said paper being capable of transmitting visible light from a rear face to the front face to cause sufficient contrast between the substantially non-translucent information and the transmitted light to enable the information to be read by a human eye viewing the front face of the document when visible light is transmitted through the document from the rear face to the front face thereof.

14. Paper according to claim 13 wherein said document portion has a transmission factor averaging about 3% in the visible light range.

15. Paper according to claim 13 wherein said document portion has a transmission factor ranging from substantially zero for light with a wavelength of about 450 millimicrons to about 5% for light with a wavelength of about 700 millimicrons.

16. Paper according to claim 13 wherein said information is of a substantially black substantially non-translucent colour.

17. Paper according to claim 16 wherein said document portion has a transmission factor averaging about 3% in the visible light range.

18. Paper according to claim 16 wherein said transmission factor ranges from substantially zero for light with a wavelength about 450 millimicrons to about 5% for light with a wavelength about 700 millimicrons.

* * * * *